US007155867B2

(12) United States Patent
Saldarelli et al.

(10) Patent No.: US 7,155,867 B2
(45) Date of Patent: Jan. 2, 2007

(54) ARCUATE TAPER LOCK ANCHOR BASE PLATE AND ANCHOR ASSEMBLY WITH THE BASE PLATE

(75) Inventors: Thomas A. Saldarelli, Yorktown Heights, NY (US); Jerry R. Amato, Yorktown Heights, NY (US)

(73) Assignee: Paragon Aquatics, a division of Pentair Pool Products, Inc., Langrangeville, NY (US)

( * ) Notice: Subject to any disclaimer, the term of this patent is extended or adjusted under 35 U.S.C. 154(b) by 154 days.

(21) Appl. No.: 10/626,913

(22) Filed: Jul. 25, 2003

(65) Prior Publication Data

US 2005/0016085 A1 Jan. 27, 2005

(51) Int. Cl.
*E02D 27/00* (2006.01)

(52) U.S. Cl. ..... 52/292; 52/296; 52/301; 52/170

(58) Field of Classification Search ..... 51/296, 51/297, 298, 301, 732.3, 170, 736.1, 736.4, 51/745.17, 731.2, 731.4, 248, 256; 256/65.14; 403/192, 343, 361, 367, 408.1, 409.1; 108/158.11; 248/188.8, 548, 156, 630, 545; 52/292
See application file for complete search history.

(56) References Cited

U.S. PATENT DOCUMENTS 1,947,413 A * 2/1934 Hay ..... 249/1
2,826,470 A * 3/1958 Denton ..... 248/188.8
3,312,440 A * 4/1967 Walter ..... 248/188.8
3,391,660 A * 7/1968 Stewart ..... 108/158.11
3,401,908 A * 9/1968 Rapata ..... 248/188.8
D262,093 S * 12/1981 Bush et al. ..... D8/386
4,673,157 A * 6/1987 Wells ..... 249/13
D337,258 S * 7/1993 Mansau ..... D9/544
5,499,737 A * 3/1996 Kraus ..... 220/787
5,605,023 A * 2/1997 Biernazki ..... 52/301
5,660,013 A 8/1997 Saldarelli et al.
5,706,559 A * 1/1998 Oliver et al. ..... 267/49
5,890,333 A * 4/1999 Boroviak ..... 52/292
5,901,525 A * 5/1999 Doeringer et al. ..... 52/736.4
6,032,695 A * 3/2000 Wellen et al. ..... 138/89
6,210,069 B1 * 4/2001 Speck ..... 403/408.1
6,336,620 B1 * 1/2002 Belli ..... 248/519
6,588,717 B1 * 7/2003 Carnahan et al. ..... 248/188.8
6,745,530 B1 * 6/2004 Nesbitt ..... 52/301

* cited by examiner

*Primary Examiner*—Basil Katcheves
(74) *Attorney, Agent, or Firm*—Pearne & Gordon LLP

(57) ABSTRACT

An anchor assembly for supporting a post and a base plate for the assembly. The assembly includes a tubular anchor body with an arcuate interior area. The anchor body is configured to receive a post having an arcuate exterior profile and a hollow lower end. The base plate is for connection with the anchor body. The base plate has an arcuate portion shaped congruently to the anchor body. The base plate has an arcuate conical portion that has a cross-sectional area that is complementary to the hollow lower end of the post and that has a greatest radial dimension at a base of the conical portion. The greatest radial dimension is greater than a complementary dimension of an interior surface of the post to cause the interior surface to slide over the conical portion and the conical portion to frictionally engage the post to prevent lateral movement of the post.

12 Claims, 4 Drawing Sheets

ARCUATE TAPER LOCK ANCHOR BASE PLATE AND ANCHOR ASSEMBLY WITH THE BASE PLATE

BACKGROUND OF THE INVENTION

In the technology of swim starting platforms, there is a continual need for improvements. U.S. Pat. No. 5,660,013 is directed to one type of improvement for swim starting platforms. Specifically, that patent describes and claims a technological advance concerning an anchor lock system for a removable platform. The system makes use of a base plate that has four projections that, together, provide four distinct corners of a pyramidal outline. The advancement provided by the invention of the above-mentioned patent is significant. As will be appreciated, the advancement provided by the invention of the above-mentioned patent, is associated with rectangular construction configurations. As such, rectangular construction considerations, etc. must be adhered to during manufacture of systems in accordance with the invention of the above-mentioned patent.

SUMMARY OF THE PRESENT INVENTION

In accordance with one aspect, the present invention provides an anchor assembly for supporting a post. The assembly includes a hollow tubular anchor body that extends along an axis and that has an arcuate interior cross-sectional area. The anchor body is configured to receive an axially-elongate tubular post that has an arcuate exterior profile and that has at least a hollow lower end bounded by an interior surface. A base plate of the assembly is connected to and closes one end of the anchor body. The base plate has an arcuate portion that is shaped congruent to the arcuate cross-sectional area of the anchor body and that is mated into the cross-sectional area of the anchor body. The base plate has an upstanding arcuate conical portion. The conical portion has a cross-sectional area that is complementary to the hollow lower end of the post and has a greatest radial dimension at a base of the conical portion. The greatest radial dimension is greater than a complementary dimension of the interior surface of the post to cause the interior surface of the post to slide over the conical portion and the conical portion to frictionally engage the post to prevent lateral movement of the post relative to the base plate.

In accordance with another aspect, the present invention provides a base plate insert for use with an axially-elongate tubular anchor body within an anchor assembly for supporting an axially-elongate tubular post. The anchor body has an arcuate interior cross-sectional area. The tubular post has an arcuate exterior profile and has at least a hollow lower end bounded by an interior surface. The base plate is for connection to and closing of one end of the anchor body. The base plate includes an arcuate portion shaped congruently to the arcuate cross-sectional area of the anchor body for mating into the cross-sectional area of the anchor body. The base plate includes an upstanding arcuate conical portion. The conical portion has a cross-sectional area that is complementary to the hollow lower end of the post and has a greatest radial dimension at a base of the conical portion. The greatest radial dimension is greater than a complementary dimension of the interior surface of the post to cause the interior surface of the post to slide over the conical portion and the conical portion to frictionally engage the post to prevent lateral movement of the post relative to the base plate.

BRIEF DESCRIPTION OF THE DRAWINGS

The foregoing and other features and advantages of the present invention will become apparent to those skilled in the art to which the present invention relates upon reading the following description with reference to the accompanying drawings wherein.

DESCRIPTION OF EXAMPLE EMBODIMENT

Figure 1:
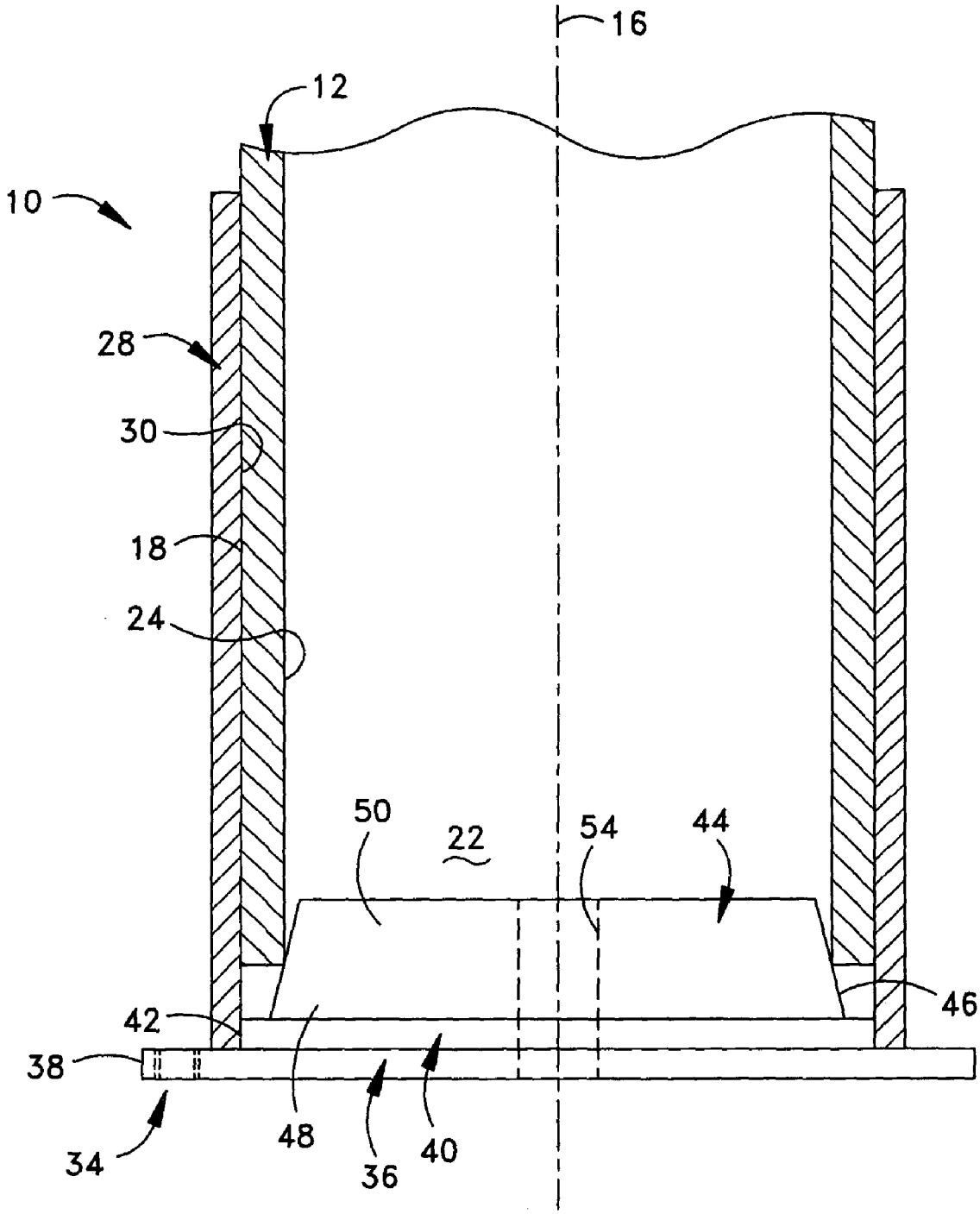
FIG. 1 is a view, partially in section, of an anchor assembly in accordance with the present invention, with a swim start platform post, shown in section, located therein.
Figure 2:
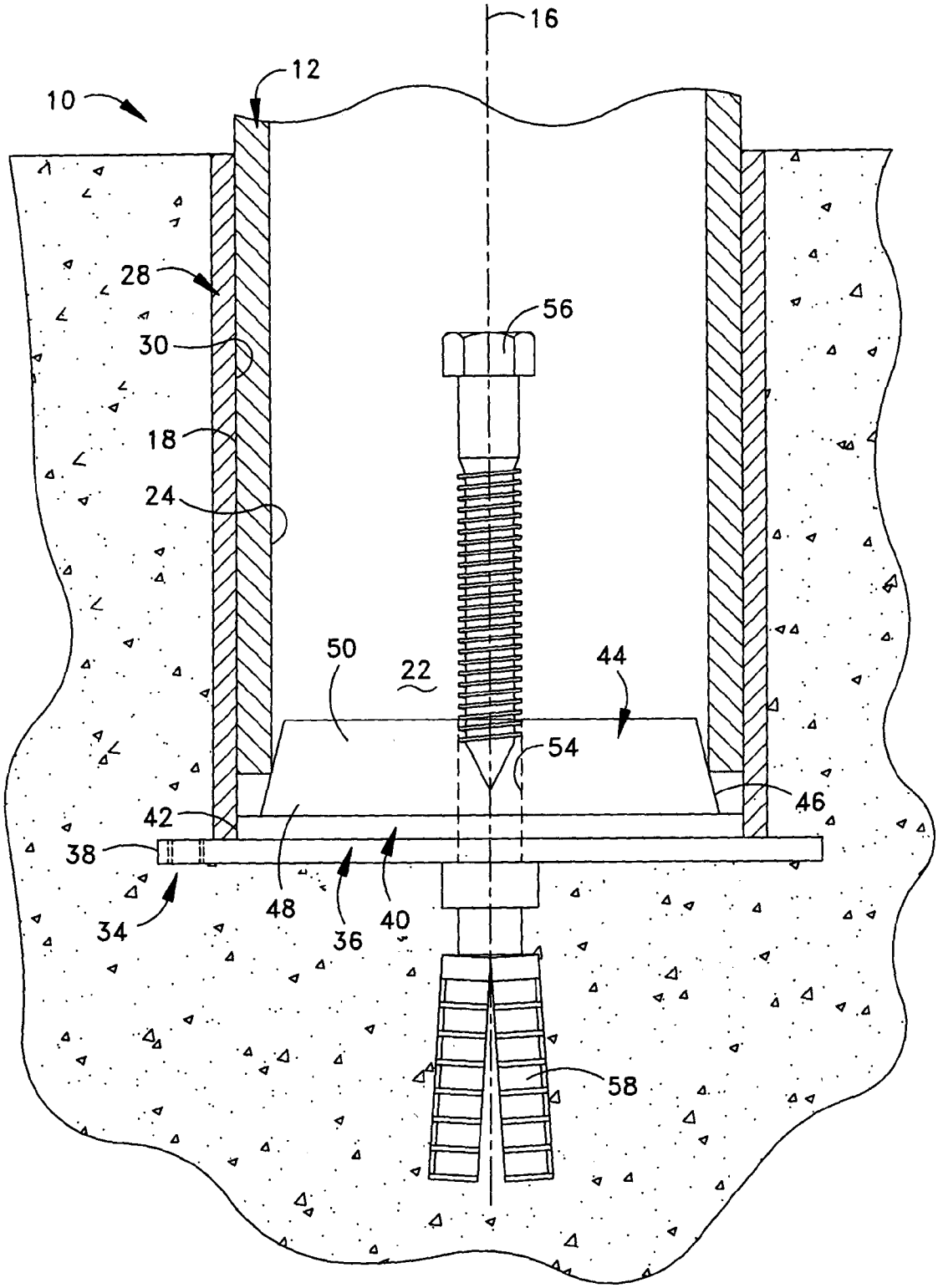
FIG. 2 is a view similar to FIG. 1, but shows the anchor assembly located in a floor adjacent to a swimming pool.

An example anchor assembly 10, in accordance with the present invention, for supporting a swim start platform post 12 is shown in FIG. 1. It is to be appreciated that the post 12 is the only shown part of the swim start platform. However, the person of ordinary skill in the art will appreciate that the swim start platform has a surface upon which a swimmer stands, prior to leaving the platform to enter swimming pool water, and a plurality of downwardly extending posts that support the platform surface. The person of ordinary skill in the art will also appreciate that the swim start platform may have various other structures, constructions, and features that need not be discussed herein. It is sufficient to appreciate that the swim start platform is removable from the anchor assembly 10 and an associated floor or deck 14 (FIG. 2, hereinafter referred to simply as the floor) into which the anchor assembly is located.

The post 12 is tubular and elongate, at least for a segment that needs to be considered herein, along an axis 16. An exterior surface 18 of the post 12 is arcuate. Thus, the post 12 has an arcuate exterior profile. In one example, the arcuate exterior surface 18 is cylindrical about the axis 16 such that the exterior surface bounds a circle when viewed along a cross-section of the post 12 (e.g., has a circular cross-section). Also, the post 12 has at least a hollow lower end 22 bounded by an interior surface 24. However, it is to be appreciated that the post 12 may be hollow for a significant portion of its overall length. The interior surface 24 of the hollow lower end 22 is arcuate. In the shown example, similar to the exterior surface 18, the interior surface 24 is cylindrical about the axis 16 such that the interior surface bounds a circle (e.g., has a circular cross-section).

A hollow tubular anchor body 28 of the assembly 10 extends along the same axis 16 when the post 12 is located within the anchor body 28. As such, the anchor body 28 is axially elongate. An interior surface 30 of the anchor body 28 is arcuate about the axis 16. In one example, the interior surface 30 is cylindrical and thus bounds a circle when viewed along a cross-section of the anchor body 28 (e.g., has a circular cross-section). The interior surface 30 of the anchor body 28 is dimensioned to be only slightly larger than the exterior surface 18 of the post 12. As such, the post 12 is insertable and removable (i.e., vertical movement) with respect to the anchor body 28. However, the fit of the post 12 into the anchor body 28 is somewhat snug to aid in prevention of lateral (i.e., side to side) movement relative to the anchor body 28. It is to be appreciated that the anchor body 28 may have surface contouring (e.g., ridges, projections, etc.) and/or other means to aid in the prevention of lateral movement of the post 12 and yet permit vertical movement for insertion and removal of the post.

Figure 4:
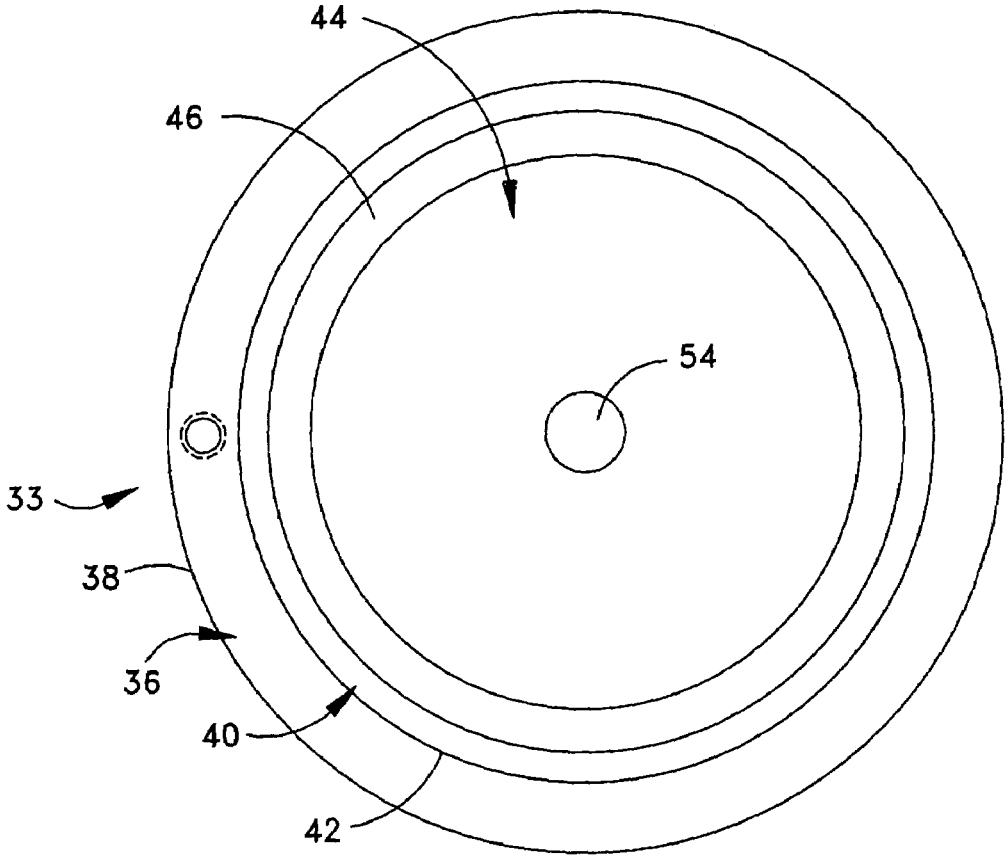
FIG. 4 is a plan view of the base plate of FIG. 3.
Figure 3:
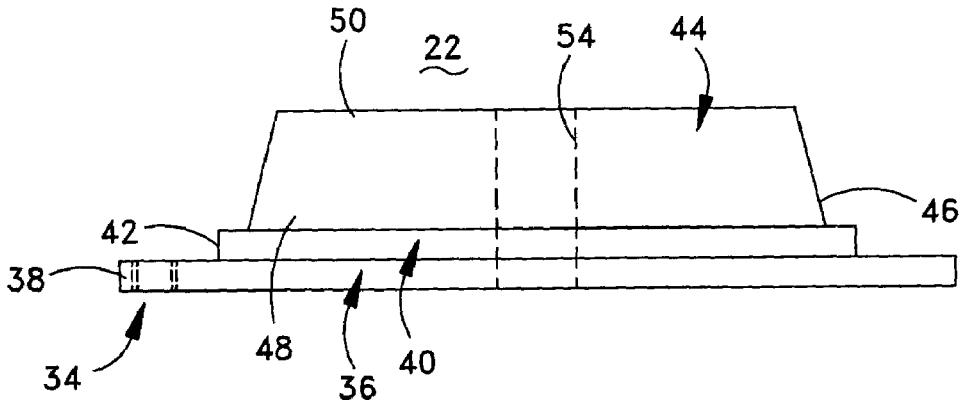
FIG. 3 is a side view of an example base plate in accordance with the present invention and usable as part of the example anchor assembly of FIG. 1.
Figure 5:
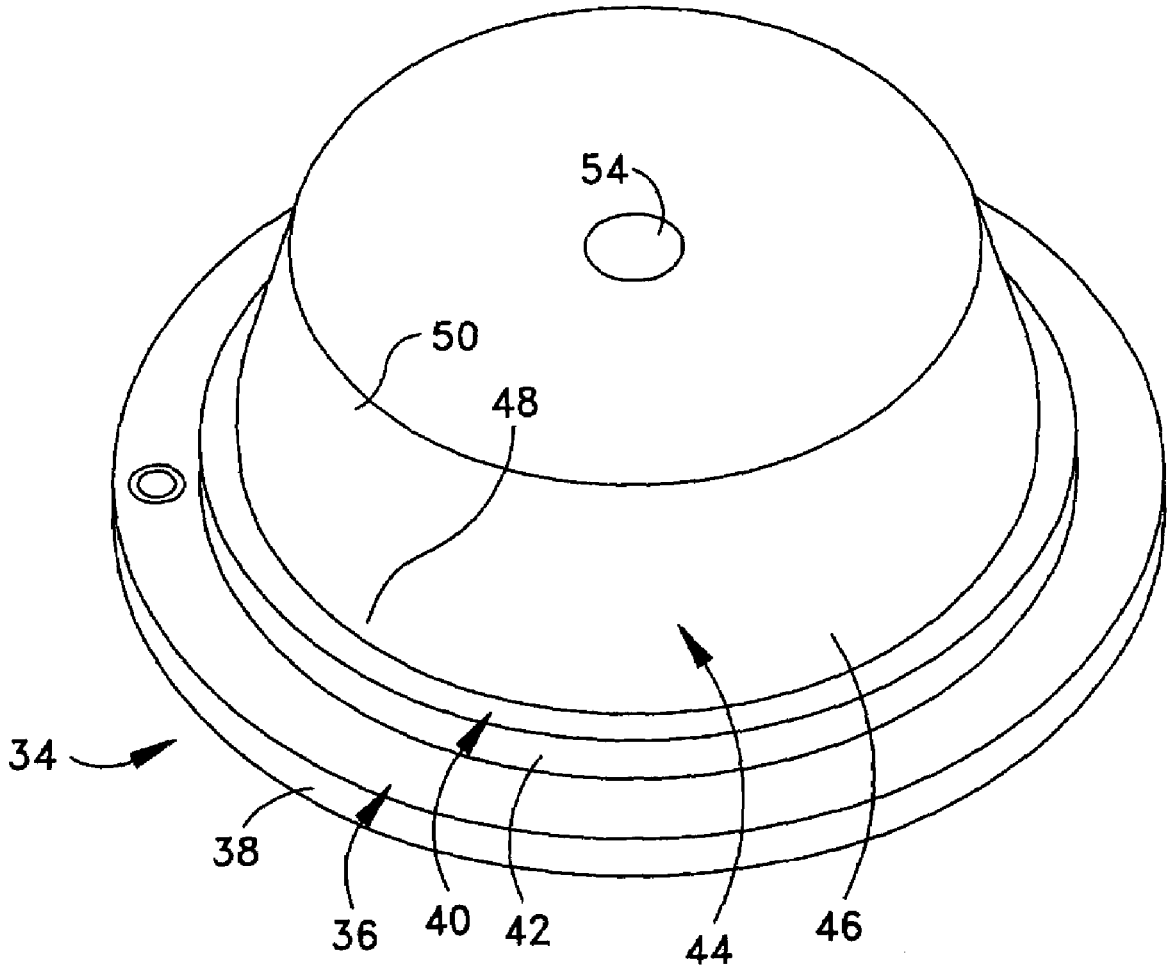
FIG. 5 is a perspective view of the base plate of FIGS. 3 and 4.

A base plate 34 (FIGS. 3–5) of the assembly 10 is an aspect of the present invention. The base plate 34 has an arcuate configuration. In the shown example, the base plate 34 has an overall circular configuration to be congruent with the circular cross-section of the anchor body 28. The base plate 34 includes an arcuate flange 36 at a lower most extent of the base plate. In the shown example, the flange 36 is circular. Specifically, a radially outer (i.e., exterior) surface 38 of the flange 36 is circular. The flange 36 has an outermost radial extent that is greater than the radial extent of the anchor body 28.

Located above the flange 36 is an arcuate portion 40 of the base plate 34 that, in the shown example, is circular. Specifically, a radially outer (i.e., exterior) surface 42 of the arcuate portion 40 is circular. It will be appreciated that the circular shape is congruent to the circular cross-sectional area of the anchor body 28. The outer radial dimension of the arcuate (circular) portion 40 is less than the outer radial dimension of the flange 36. Also, the outer radial dimension of the arcuate portion 40 is the same as or just slightly smaller than the radial dimension of the interior surface 30 of the anchor body 28. As such, the arcuate portion 40 fits into, i.e., mates with, the lowermost end of the anchor body 28. In the shown example, the anchor body 28 is affixed to the base plate 34 at the arcuate portion 40 via welding or other means of connection.

Extending upward from the arcuate portion 40 of the base plate 34 is an arcuate conical portion 44 of the base plate 34. It is to be appreciated that the upward extend of the conical portion 44 is considered to provide an upstanding portion with regard to the rest of the base plate 34. The conical portion 44 has a cross-sectional area that is complementary to the hollow lower end 22 of the post 12. In the shown example, the conical portion 44 of the base plate 34 has a circular cross-section. As such, a radially outer (i.e., exterior) surface 46 is shaped as a circular conic. Also, in the shown example, the conical portion 44 is a truncated conic.

The conical portion 44 has a greatest radial dimension at a base 48 of the conical portion, which is adjacent to the arcuate portion 40. The greatest radial dimension of the conical portion 44 is less than the radial extent of the arcuate portion 40. Also, the greatest radial dimension of the conical portion 44 is greater than a complementary dimension of the interior surface 24 of the post 12. This relative dimensioning of the conical portion 44 and the post 12 causes the interior surface 24 of the post to move past/slide over an upper portion 50 of the conical portion 44. The relative dimensioning also results in frictional engage between the conical portion 44 and the post 12 at some location toward the base 48 of the conical portion to prevent lateral movement of the post 12 relative to the base plate 34.

In the shown example, the greatest radial dimension of the conical portion 44 of the base plate 34 is sufficiently large to cause the frictional engagement with the post 12 at a location of the post that is spaced from the arcuate portion 40 of the base plate. Further, the post 12 is entrapped or squeezed between the conical portion 44 and the anchor body 28 at the location of frictional engagement with the conical portion.

In the shown example, the anchor assembly 10 is made of at least two parts, i.e., the anchor body 28 and the base plate 34. However, it is to be appreciated that the assembly 10 may be made via unitary construction. Also, additional parts may be included in the assembly 10 without deviating form the scope of the present invention.

Turning the mounting of the anchor assembly 10 into the floor 14 adjacent to the pool, the floor may be made of any material. However, the floor 14 is typically made of a cement/concrete material with a sealant coating. In the shown example, the anchor assembly 10 is embedded into the material of the floor 14. The flange 36 provides aid in retaining the anchor assembly 10 in the floor 14.

The anchor assembly 10 may have additional structure(s) to aid in retaining the assembly in the floor 14. In the shown example, the base plate 34 has an axially aligned through hole 54 that extends from a top of the conical portion 44 all the way through the bottom of the flange 36. A fastener 56 extends through the base plate 34 and into the material of the floor 14. In one example, a threaded screw may be used as the fastener 56. However, it is to be appreciated that any suitable fastener may be employed. Also, it is to be noted that an anchor member 58, such as a molley anchor, may also be used in the material of the floor to provide a location for the fastener to engage.

From the above description of the invention, those skilled in the art will perceive improvements, changes and modifications. Such improvements, changes and modifications within the skill the of the art are intended to be covered by the appended claims.

Having described the invention, the following is claimed:

1. A floor anchor assembly for supporting an axially-elongate tubular post insertable and removable from the anchor assembly, the post being non-concrete, having an arcuate exterior profile and having at least a hollow lower end bounded by an arcuate interior surface, the assembly including:

a concrete floor structure having an upper surface a tubular anchor body located within and engaged with the floor structure, the anchor body extending along an axis and having a hollow interior with an arcuate interior cross-sectional area, the hollow interior of the anchor body having two open ends and being configured to receive the post within the hollow interior of the anchor body from one open end, the one open end receiving the post being located adjacent to the upper surface of the floor structure; and a base plate, located within and engaged with the floor structure, connected to and closing the end of the anchor body opposite to the end that receives the post, the base plate having an arcuate portion shaped congruently to the arcuate cross-sectional area of the interior of the anchor body and mated into the interior of the anchor body, the base plate having an upstanding arcuate conical portion located within the interior of the anchor body, the conical portion having a cross-sectional area that is complementary to the hollow lower end of the post and having a greatest radial dimension at a base of the conical portion, the anchor body and the conical portion bounding an annular space that extends about the conical portion for receiving the hollow lower end of the post, the greatest radial dimension of the conical portion being greater than a complementary dimension of the interior surface of the post to cause the interior surface of the post to slide over the conical portion and the conical portion to frictionally engage the post such that the hollow lower end of the post wedges against the conical portion within the annular space to prevent lateral movement of the post relative to the base plate, and without any structure connected to and above the base plate that prevents lateral movement of the post and that prevents removal of the post from the conical portion and anchor body.

2. An assembly as set forth in claim 1, wherein the anchor body has a circular interior cross-sectional area, bounded by a cylindrical surface of the anchor body, to receive the post which has a circular exterior profile, the arcuate portion of the base plate is upstanding, circular and has a radially outer surface shaped as a cylinder to mate with the cylindrical surface of the anchor body that bounds the circular cross-section anchor body, and the conical portion of the base plate is a circular conic.

3. An assembly as set forth in claim 1, wherein the conical portion of the base plate is a truncated conic, and the conical portion is spaced radially inward from the anchor body at the greatest radial dimension of the conical portion such that the annular space that extends about the conical portion extends to the greatest radial dimension of the conical portion to receive the lower end of the post with a substantial portion of the conical portion located within the lower end of the post.

4. An assembly as set forth in claim 1, wherein the base plate has an arcuate flange that extends in an outward radial direction from the arcuate portion of the base plate, the flange of the base plate has an outermost radial extent that is greater than an outermost radial extent of the anchor body, the flange being affixed within the floor structure.

5. An assembly as set forth in claim 1, wherein the post is rigid to permit insertion and removal, the greatest radial dimension of the conical portion of the base plate is sufficiently large to cause frictional engagement with the rigid post at a location of the post that is spaced from the arcuate portion of the base plate such that the rigid post is stopped before reaching the arcuate portion with a substantial portion of the conical portion located within the lower end of the rigid post.

6. An anchor assembly for supporting an axially-elongate tubular post insertable and removable from the anchor assembly, the post being non-concrete, having an arcuate exterior profile and having at least a hollow lower end bounded by an arcuate interior surface, the assembly including:

a tubular anchor body extending along an axis and having a hollow interior with an arcuate interior cross-sectional area, the hollow interior of the anchor body having two open ends and being configured to receive the post within the hollow interior of the anchor body from one open end; and a base plate connected to and closing the end of the anchor body opposite to the end that receives the post, the base plate having an arcuate portion shaped congruently to the arcuate cross-sectional area of the interior of the anchor body and mated into the interior of the anchor body, the base plate having an upstanding arcuate conical portion located within the interior of the anchor body, the conical portion having a cross-sectional area that is complementary to the hollow lower end of the post and having a greatest radial dimension at a base of the conical portion, the anchor body and the conical portion bounding an annular space that extends about the conical portion for receiving the hollow lower end of the post, the greatest radial dimension of the conical portion being greater than a complementary dimension of the interior surface of the post to cause the interior surface of the post to slide over the conical portion and the conical portion to frictionally engage the post such that the hollow lower end of the post wedges against the conical portion within the annular space to prevent lateral movement of the post relative to the base plate, and without any structure connected to and above the base plate that prevents removal of the post from the conical portion and anchor body;

wherein the conical portion of the base plate has an axially extending opening to receive a retaining member for retaining the base plate stationary while the tubular post is inserted and removed from the anchor assembly.

7. A floor assembly for supporting an axially-elongate tubular post insertable and removable from the anchor assembly, the post being non-concrete, having an arcuate exterior profile and having at least a hollow lower end bounded by an interior surface, the assembly including:

a concrete floor structure having an upper surface;

surface means, located within the floor structure, extending along an axis and providing a hollow arcuate interior cross-sectional area, for receiving the post, the hollow interior of the surface means having two open ends, one open end being located adjacent to the upper surface of the floor structure, with the post extending into the interior of the surface means from the one open end; and a base plate, located within the floor structure, located at and closing the end of the surface means opposite to the end that receives the post, the base plate having an arcuate portion shaped congruently to the arcuate cross-sectional area of the interior of the surface means and mated into the cross-sectional area of the surface means, the base plate having an upstanding arcuate conical portion located within the interior of the anchor body, the conical portion having a cross-sectional area that is complementary to the hollow lower end of the post and having a greatest radial dimension at a base of the conical portion, the anchor body and the surface means bounding an annular space that extends about the conical portion for receiving the hollow lower end of the post, the greatest radial dimension of the conical portion being greater than a complementary dimension of the interior surface of the post to cause the interior surface of the post to slide over the conical portion and the conical portion to frictionally engage the post such that the hollow lower end of the post wedges against the conical portion within the annular space to prevent lateral movement of the post relative to the base plate, and without any structure connected to and above the base plate that prevents lateral movement of the post and that prevents removal of the post from the conical portion and anchor body.

8. An assembly for supporting an axially-elongate tubular post insertable and removable from the anchor assembly, the post being non-concrete, having an arcuate exterior profile and having at least a hollow lower end bounded by an interior surface, the assembly including:

surface means, extending along an axis and providing a hollow arcuate interior cross-sectional area, for receiving the post, the hollow interior of the surface means having two open ends with the post extending into the interior of the surface means from one open end; and a base plate located at and closing the end of the surface means opposite to the end that receives the post, the base plate having an arcuate portion shaped congruently to the arcuate cross-sectional area of the interior of the surface means and mated into the cross-sectional area of the surface means, the base plate having an upstanding arcuate conical portion located within the interior of the anchor body, the conical portion having a cross-sectional area that is complementary to the hollow lower end of the post and having a greatest radial dimension at a base of the conical portion, the anchor body and the surface means bounding an annular space that extends about the conical portion for receiving the hollow lower end of the post, the greatest radial dimension of the conical portion being greater than a complementary dimension of the interior surface of the post to cause the interior surface of the post to slide over the conical portion and the conical portion to frictionally engage the post such that the hollow lower end of the post wedges against the conical portion within the annular space to prevent lateral movement of the post relative to the base plate, and without any structure connected to and above the base plate that prevents removal of the post from the conical portion and anchor body;

wherein the surface means has a circular interior cross-sectional area, bounded by a cylidrical surface of the surface means, to receive the post which has a circular exterior profile, the arcuate portion of the base plate is upstanding, circular and has a radially outer surface shaped as a cylinder to mate with the cylidrical surface that bounds the circular cross-section of the surface means, and the conical portion of the base plate is a circular conic.

9. An anchor assembly as set forth in claim 7, wherein the conical portion of the base plate is a truncated conic without additional structure affixed to the truncated conic.

10. An assembly as set forth in claim 7, wherein the base plate has an arcuate flange that extends in an outward radial direction from the arcuate portion of the base plate, the flange of the base plate has an outermost radial extent that is greater than a radial distance to the surface means and the flange is affixed to the floor structure.

11. An assembly as set forth in claim 7, wherein the greatest radial dimension of the conical portion of the base plate is sufficiently large to cause frictional engagement with the post at a location of the post that is spaced from the arcuate portion of the base plate such that the post is stopped before reaching the arcuate portion with a substantial portion of the conical portion located within the lower end of the post.

12. An anchor assembly as set forth in claim 7, wherein the conical portion of the base plate has an axially extending opening to receive a retaining member for retaining the base plate stationary while the tubular post is inserted and removed from the anchor assembly.

* * * * *